US009530435B2

(12) United States Patent
Onishi

(10) Patent No.: US 9,530,435 B2
(45) Date of Patent: Dec. 27, 2016

(54) VOICED SOUND INTERVAL CLASSIFICATION DEVICE, VOICED SOUND INTERVAL CLASSIFICATION METHOD AND VOICED SOUND INTERVAL CLASSIFICATION PROGRAM

(75) Inventor: Yoshifumi Onishi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 539 days.

(21) Appl. No.: 13/982,437

(22) PCT Filed: Jan. 25, 2012

(86) PCT No.: PCT/JP2012/051553

§ 371 (c)(1),
(2), (4) Date: Jul. 29, 2013

(87) PCT Pub. No.: WO2012/105385

PCT Pub. Date: Aug. 9, 2012

(65) Prior Publication Data

US 2013/0332163 A1 Dec. 12, 2013

(30) Foreign Application Priority Data

Feb. 1, 2011 (JP) ..... 2011-019812
Jun. 21, 2011 (JP) ..... 2011-137555

(51) Int. Cl.
*G10L 25/93* (2013.01)
*G10L 25/21* (2013.01)
*G10L 21/0216* (2013.01)

(52) U.S. Cl.
CPC ..... *G10L 25/93* (2013.01); *G10L 25/21* (2013.01); *G10L 2021/02166* (2013.01)

(58) Field of Classification Search
CPC ..... G10L 25/93; G10L 2025/932; G10L 2025/935; G10L 2025/937; G10L 25/78; G10L 25/81; G10L 25/84; G10L 25/87; G10L 2025/783; G10L 2025/786; G10L 2021/02166
See application file for complete search history.

(56) References Cited

U.S. PATENT DOCUMENTS 7,590,526 B2 * 9/2009 Fukuda ..... 704/211
2004/0014445 A1 * 1/2004 Godsill ..... G10L 15/20 455/226.1

(Continued)

FOREIGN PATENT DOCUMENTS

JP 2003-271166 A 9/2003
JP 2004-170552 A 6/2004

(Continued)

OTHER PUBLICATIONS

Paul Fearnhead, "Particle Filters for mixture models with an unknown number of components", Journal of Statistics and Computing, 2004, pp. 11-21, vol. 14.

(Continued)

*Primary Examiner* — Richemond Dorvil
*Assistant Examiner* — Kee Young Lee
(74) *Attorney, Agent, or Firm* — Sughrue Mion, PLLC

(57) ABSTRACT

The voiced sound interval classification device comprises a vector calculation unit which calculates, from a power spectrum time series of voice signals, a multidimensional vector series as a vector series of a power spectrum having as many dimensions as the number of microphones, a difference calculation unit which calculates, with respect to each time of the multidimensional vector series, a vector of a difference between the time and the preceding time, a sound source direction estimation unit which estimates, as a sound source direction, a main component of the differential vector, and a voiced sound interval determination unit which determines whether each sound source direction is in a voiced sound interval or a voiceless sound interval by using (Continued)

VOICED SOUND INTERVAL CLASSIFICATION DEVICE 100 a predetermined voiced sound index indicative of a likelihood of a voiced sound interval of the voice signal applied at each time.

9 Claims, 10 Drawing Sheets

(56) References Cited

U.S. PATENT DOCUMENTS

2005/0203981 A1* 9/2005 Sawada ..... G01S 3/46 708/322
2006/0058983 A1* 3/2006 Araki ..... G06K 9/6245 702/190
2006/0204019 A1* 9/2006 Suzuki ..... G10L 21/0272 381/92
2006/0245601 A1* 11/2006 Michaud ..... G01S 5/22 381/92
2007/0005350 A1* 1/2007 Amada ..... 704/211
2008/0199024 A1* 8/2008 Nakadai ..... H04S 7/00 381/92
2008/0215651 A1* 9/2008 Sawada ..... G06K 9/6245 708/205
2009/0285409 A1 11/2009 Yoshizawa et al.
2009/0310444 A1* 12/2009 Hiroe ..... G01S 3/801 367/125
2010/0241426 A1* 9/2010 Zhang ..... G10L 21/0208 704/226
2011/0054891 A1* 3/2011 Vitte ..... H04R 3/005 704/233
2011/0082690 A1* 4/2011 Togami ..... H04R 1/406 704/201

FOREIGN PATENT DOCUMENTS

JP 2008-158035 A 7/2008
JP 2008158035 A * 7/2008
JP 2010-217773 A 9/2010
WO 2005/024788 A1 3/2005
WO 2008/056649 A1 5/2008

OTHER PUBLICATIONS

Bruno A. Olshausen, et al., "Emergence of simple-cell receptive field properties by learning a sparse code for natural images", Nature, Jun. 1996, pp. 607-609, vol. 381.
Shoko Araki et al., "Kansoku Shingo Vector Seikika to Clustering ni yoru Ongen Runri Shuho to sono Hyoka", Report of the 2005 Autumn Meeting, The Acoustical Society of Japan, Sep. 20, 2005, pp. 591-592.

* cited by examiner

VOICED SOUND INTERVAL CLASSIFICATION DEVICE 100

VOICED SOUND INTERVAL CLASSIFICATION DEVICE 100

-- Prior Art --

-- Prior Art --

OBSERVATION SIGNAL CLASSIFICATION UNIT 501

-- Prior Art --

-- Prior Art --

-- Prior Art --

VOICED SOUND INTERVAL CLASSIFICATION DEVICE, VOICED SOUND INTERVAL CLASSIFICATION METHOD AND VOICED SOUND INTERVAL CLASSIFICATION PROGRAM

CROSS REFERENCE TO RELATED APPLICATIONS

This application is a National Stage of International Application No. PCT/JP2012/051553 filed Jan. 25, 2012, claiming priority based on Japanese Patent Application No. 2011-019812 filed Feb. 1, 2011 and Japanese Patent Application No. 2011-137555 filed Jun. 21, 2011, the contents of all of which are incorporated herein by reference in their entirety.

TECHNICAL FIELD

The present invention relates to a technique of classifying a voiced sound interval from voice signals, and more particularly, a voiced sound interval classification device which classifies a voiced sound interval from voice signals collected by a plurality of microphones on a sound source basis, and a voiced sound interval classification method and a voiced sound interval classification program therefor.

BACKGROUND ART

Numbers of techniques have been disclosed for classifying voiced sound intervals from voice signals collected by a plurality of microphones, one of which is recited, for example, in Patent Literature 1.

For correctly determining a voiced sound interval of each of a plurality of microphones, the technique recited in Patent Literature 1 includes firstly classifying each observation signal of each time frequency converted into a frequency domain on a sound source basis and making determination of a voiced sound interval or a voiceless sound interval with respect to each observation signal classified.

Shown in FIG. 5 is a diagram of a structure of a voiced sound interval classification device according to such background art as Patent Literature 1. Common voiced sound interval classification devices according to the background art include an observation signal classification unit 501, a signal separation unit 502 and a voiced sound interval determination unit 503.

Shown in FIG. 8 is a flow chart showing operation of a voiced sound interval classification device having such a structure according to the background art.

The voiced sound interval classification device according to the background art firstly receives input of a multiple microphone voice signal $x_m$ (f, t) obtained by time-frequency analysis by each microphone of voice observed by a number M of microphones (here, m denotes a microphone number, f denotes a frequency and t denotes time) and a noise power estimate $\lambda_m$ (f) for each frequency of each microphone (Step S801).

Next, the observation signal classification unit 501 classifies a sound source with respect to each time frequency to calculate a classification result C (f, t) (Step S802).

Then, the signal separation unit 502 calculates a separation signal $y_n$ (f, t) of each sound source by using the classification result C (f, t) and the multiple microphone voice signal (Step S803).

Then, the voiced sound interval determination unit 503 makes determination of voiced sound or voiceless sound with respect to each sound source based on S/N (signal-noise ratio) by using the separation signal $y_n$ (f, t) and the noise power estimate $\lambda_m$ (f) (Step S804).

Here, as shown in FIG. 6, the observation signal classification unit 501, which includes a voiceless sound determination unit 602 and a classification unit 601, operates in a manner as follows. Flow chart illustrating operation of the observation signal classification unit 501 is shown in FIG. 9.

First, an S/N ratio calculation unit 607 of the voiceless sound determination unit 602 receives input of the multiple microphone voice signal $x_m$ (f, t) and the noise power estimate $\lambda_m$ (f) to calculate an S/N ratio $\gamma_m$ (f, t) for each microphone according to an Expression 1 (Step S901).

$$\gamma_m(f, t) = \frac{|x_m(f, t)|^2}{\lambda_m(f)} \quad \text{(Expression 1)}$$

Next, a nonlinear conversion unit 608 executes nonlinear conversion with respect to the S/N ratio for each microphone according to the following expression to calculate an S/N ratio $G_m$ (f, t) as of after the nonlinear conversion (Step S902).

$$G_m(f,t)=\gamma_m(f,t)-\ln \gamma_m(f,t)-1$$

Next, a determination unit 609 compares the predetermined threshold value η' and S/N ratio $G_m$ (f, t) of each microphone as of after the nonlinear conversion and when the S/N ratio $G_m$ (f, t) as of after the nonlinear conversion is not more than the threshold value in each microphone, considers a signal at the time-frequency as noise to output C (f, t)=0 (Step S903). The classification result C (f, t) is cluster information which assumes a value from 0 to N.

Next, a normalization unit 603 of the classification unit 601 receives input of the multiple microphone voice signal $x_m$ (f, t) to calculate X'(f, t) according to the Expression 2 in an interval not determined to be noise (Step S904).

$$X'(f, t) = \frac{\begin{bmatrix} |x_1(f, t)| \\ \vdots \\ |x_M(f, t)| \end{bmatrix}}{\left\| \begin{bmatrix} |x_1(f, t)| \\ \vdots \\ |x_M(f, t)| \end{bmatrix} \right\|} \quad \text{(Expression 2)}$$

X'(f, t) is a vector obtained by normalization by a norm of an M-dimensional vector having amplitude absolute values $|x_m$ (f, t)| of signals of M microphones.

Subsequently, a likelihood calculation unit 604 calculates a likelihood $p_n$ (X'(f, t)) n=1, . . . , N of a number N of speakers expressed by a Gaussian distribution having a mean vector determined in advance and a covariance matrix with a sound source model (Step S905).

Next, a maximum value determination unit 606 outputs n with which the likelihood $p_n$ (X'(f, t)) takes the maximum value as C (f, t)=n (Step S906).

Here, although the number of sound sources N and M may differ, n will take any value of 1, . . . , M because any of the microphones is assumed to be located near each of the N speakers as sound sources.

With a Gaussian distribution having a direction of each of M-dimensional coordinate axes as a mean vector as an initial distribution, a model updating unit 605 updates a sound source model by updating a mean vector and a covariance matrix by the use of a signal which is classified into its sound source model by using a speaker estimation result.

The signal separation unit 502 separates the applied multiple microphone voice signal $x_m$ (f, t) and the C (f, t) output by the observation signal classification unit 501 into a signal yn (f, t) for each sound source according to an Expression 3.

$$y_n(f,t) = \begin{cases} x_{k(n)}(f,t) & \text{if } C(f,t) = n \\ 0 & \text{otherwise} \end{cases} \quad \text{(Expression 3)}$$

Here, k(n) represents the number of a microphone closest to a sound source n which is calculated from a coordinate axis to which a Gaussian distribution of a sound source model is close.

The voiced sound interval determination unit 503 operates in a following manner.

The voiced sound interval determination unit 503 first obtains $G_n$ (t) according to an Expression 4 by using the separation signal $y_n$ (f, t) calculated by the signal separation unit 502.

$$\gamma_n(f,t) = \frac{|y_n(f,t)|^2}{\lambda_{k(n)}(f)}, \quad \text{(Expression 4)}$$

$$G_n(t) = \frac{1}{|F|}\sum_{f\in F}[\gamma_n(f,t) - \ln\gamma_n(f,t) - 1]$$

Subsequently, the voiced sound interval determination unit 503 compares the calculated $G_n$ (t) and a predetermined threshold value η and when $G_n$ (t) is larger than the threshold value η, determines that time t is within a speech interval of the sound source n and when $G_n$ (t) is not more than η, determines that time t is within a noise interval.

F represents a set of wave numbers to be taken into consideration and |F| represents the number of elements of the set F.

Patent Literature 1: Japanese Patent Laying-Open No. 2008-158035.

Non-Patent Literature 1: P. Fearnhead, "Particle Filters for Mixture Models with an Unknown Number of Components", Statistics and Computing, vol 14, pp. 11-21, 2004.

Non-Patent Literature 2: B. A. Olshausen and D. J. Field, "Emergence of simple-cell receptive field properties by learning a sparse code for natural images", Nature vol. 381, pp 607-609, 1996.

By the technique recited in the Patent Literature 1, for sound source classification executed by the observation signal classification unit 501, calculation is made assuming that a normalization vector X'(f, t) is in a direction of a coordinate axis of a microphone close to a sound source.

In practice, however, since voice power always varies in a case, for example, where a sound source is a speaker, a normalization vector X'(f, t) is far away from a coordinate axis direction of a microphone even when a sound source position does not shift at all, so that a sound source of an observation signal cannot be classified with enough precision.

Shown in FIG. 7 is a signal observed by two microphones, for example. Assuming now that a speaker close to a microphone number 2 makes a speech, voice power always varies in a space formed of observation signal absolute values of two microphones even if a sound source position has no change, so that the vector will vary on a bold line in FIG. 7.

Here, λ1 (f) and λ2 (f) each represent noise power whose square root is on the order of a minimum amplitude observed in each microphone.

At this time, although the normalization vector X'(f, t) will be a vector constrained on a circular arc with a radius of 1, when an observed amplitude of the microphone number 1 is approximately as small as a noise level and an observed amplitude of the microphone number 2 has a region larger enough than the noise level (i.e. γ2 (f, t) exceeds a threshold value η' to consider the interval as a voiced sound interval), X'(f, t) will largely derivate from the coordinate axis of the microphone number 2 (i.e. sound source direction) to invite deterioration of a voiced sound interval classification performance.

The technique recited in the Patent Literature 1 has another problem that since the number N of sound sources is unknown in the observation signal classification unit 501, it is difficult for the likelihood calculation unit 604 to set a sound source model appropriate for sound source classification to invite deterioration of voice interval classification performance.

In a case, for example, where with two microphones and three sound sources (speakers), the third speaker is located near the middle point between the two microphones, sound sources cannot be appropriately classified by a sound source model close to the microphone axis. In addition, it is difficult to prepare a sound source model at an appropriate position apart from a microphone axis without advance-knowledge of the number of speakers, and as a result, a sound source of an observation signal cannot be classified correctly.

When deterioration of an observation signal classification performance is caused by mixed use of different kinds of microphones without being calibrated, an amplitude value or a noise level varies with each microphone to have an increased effect, resulting in further deteriorating voice interval classification performance.

OBJECT OF THE INVENTION

An object of the present invention is to solve the above-described problems and provide a voiced sound interval classification device which enables appropriate classification of a voiced sound interval of an observation signal on a sound source basis even when a volume of sound from a sound source varies or when the number of sound sources is unknown or when different kinds of microphones are used together, and a voiced sound interval classification method and a voiced sound interval classification program therefor.

SUMMARY

According to a first exemplary aspect of the invention, a voiced sound interval classification device comprises a vector calculation unit which calculates, from a power spectrum time series of voice signals collected by a plurality of microphones, a multidimensional vector series as a vector series of a power spectrum having as many dimensions as the number of the microphones, a difference calculation unit which calculates, with respect to each time of the multidimensional vector series sectioned by an arbitrary time length, a vector of a difference between the time in question and the preceding time, a sound source direction estimation unit which estimates, as a sound source direction, a main component of the differential vector obtained while allowing the vector to be non-orthogonal and exceed a space dimension, and a voiced sound interval determination unit which determines whether each sound source direction obtained by the sound source direction estimation unit is in a voiced sound interval or a voiceless sound interval by using a predetermined voiced sound index indicative of a likelihood of a voiced sound interval of the voice signal applied at each time.

According to a second exemplary aspect of the invention, a voiced sound interval classification method of a voiced sound interval classification device which classifies a voiced sound interval from voice signals collected by a plurality of microphones on a sound source basis, includes a vector calculation step of calculating, from a power spectrum time series of the voice signals collected by a plurality of microphones, a multidimensional vector series as a vector series of a power spectrum having as many dimensions as the number of the microphones, a difference calculation step of calculating, with respect to each time of the multidimensional vector series sectioned by an arbitrary time length, a vector of a difference between the time in question and the preceding time, a sound source direction estimation step of estimating, as a sound source direction, a main component of the differential vector obtained while allowing the vector to be non-orthogonal and exceed a space dimension, and a voiced sound interval determination step of determining whether each sound source direction obtained by the sound source direction estimation step is in a voiced sound interval or a voiceless sound interval by using a predetermined voiced sound index indicative of a likelihood of a voiced sound interval of the voice signal applied at each time.

According to a third exemplary aspect of the invention, a voiced sound interval classification program operable on a computer which functions as a voiced sound interval classification device which classifies a voiced sound interval from voice signals collected by a plurality of microphones on a sound source basis, which program causes the computer to execute a vector calculation processing of calculating, from a power spectrum time series of the voice signals collected by a plurality of microphones, a multidimensional vector series as a vector series of a power spectrum having as many dimensions as the number of the microphones, a difference calculation processing of calculating, with respect to each time of the multidimensional vector series sectioned by an arbitrary time length, a vector of a difference between the time in question and the preceding time, a sound source direction estimation processing of estimating, as a sound source direction, a main component of the differential vector obtained while allowing the vector to be non-orthogonal and exceed a space dimension, and a voiced sound interval determination processing of determining whether each sound source direction obtained by the sound source direction estimation processing is in a voiced sound interval or a voiceless sound interval by using a predetermined voiced sound index indicative of a likelihood of a voiced sound interval of the voice signal applied at each time.

The present invention enables appropriate classification of a voice interval of an observation signal even when a volume of sound from a sound source varies or when the number of sound sources is unknown or when different kinds of microphones are used together.

EXEMPLARY EMBODIMENT

Figure 1:
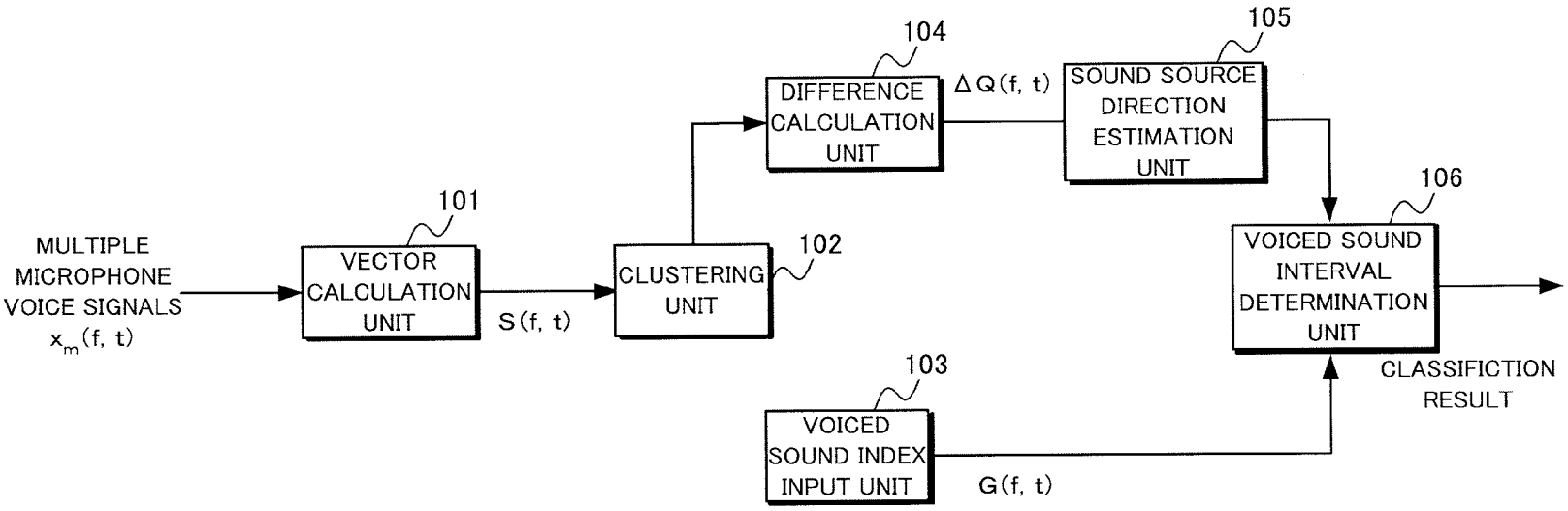
FIG. 1 is a block diagram showing a structure of a voiced sound interval classification device according to a first exemplary embodiment of the present invention.

In order to clarify the foregoing and other objects, features and advantages of the present invention, exemplary embodiments of the present invention will be detailed in the following with reference to the accompanying drawings.

Other technical problems, means for solving the technical problems and functions and effects thereof other than the above-described objects of the present invention will become more apparent from the following disclosure of the exemplary embodiments. In all the drawings, like components are identified by the same reference numerals to omit description thereof as required.

First Exemplary Embodiment

First exemplary embodiment of the present invention will be detailed with reference to the drawings. In the following drawings, no description is made as required of a structure of a part not related to a gist of the present invention and no illustration is made thereof.

FIG. 1 is a block diagram showing a structure of a voiced sound interval classification device 100 according to the first exemplary embodiment of the present invention. With reference to FIG. 1, the voiced sound interval classification device 100 according to the present embodiment includes a vector calculation unit 101, a clustering unit 102, a difference calculation unit 104, a sound source direction estimation unit 105, a voiced sound index input unit 103 and a voiced sound interval determination unit 106.

The vector calculation unit 101 receives input of a multiple microphone voice signal $x_m$ (f, t) (m=1, . . . , M) subjected to time-frequency analysis to calculate a vector S (f, t) of an M-dimensional power spectrum according to an Expression 5.

$$S(f,t)=\begin{bmatrix}|x_1(f,t)|^2\\ \vdots\\ |x_M(f,t)|^2\end{bmatrix} \quad \text{(Expression 5)}$$

Here, M represents the number of microphones.

The vector calculation unit 101 may also calculate a vector LS (f, t) of a logarithm power spectrum as shown in an Expression 6.

$$LS(f,t)=\begin{bmatrix}\ln|x_1(f,t)|^2\\ \vdots\\ \ln|x_M(f,t)|^2\end{bmatrix} \quad \text{(Expression 6)}$$

Although f represents each frequency, it is also possible to do sums of lumps each including several frequencies and make them into blocks. Hereafter, f is assumed to represent a frequency or a frequency with an index indicative of blocks of frequencies included. Also included may be a block formed of an entire frequency range to be handled.

The clustering unit 102 clusters the M-dimensional space vector calculated by the vector calculation unit 101.

When a vector S (f, 1:t) of an M-dimensional power spectrum of a frequency f from time 1 to t is obtained, the clustering unit 102 expresses a state of a number t of vector data clustered as $z_t$. Unit of time is a signal sectioned by a predetermined time length.

h ($z_t$) is assumed to be a function representing an arbitrary amount h which can be calculated from a system having a clustering state $z_t$. The present exemplary embodiment is premised on that clustering is executed stochastically.

The clustering unit 102 is capable of calculating an expected value of h by integrating every clustering state $z_t$ with a post-distribution p ($z_t$|S (f, 1:t)) multiplied according to a second member of an Expression 7.

$$E_t[h]=\int h(z_t)p(z_t|S(f,1:t))dz_t\cong\Sigma_{i-1}^{L}\omega_t^i h(z_t^l) \quad \text{(Expression 7)}$$

In practice, however, an expected value is approximately calculated by taking a weighted sum by using a number L of clustering states $z_t^l$ (l=1, . . . , L) and their weights $\omega_t^l$ as shown in a third member of the Expression 7.

Here, a clustering state $z_t^l$ represents how each of the number t of data is clustered. In a case of t=3, for example, every clustering combination of three data is possible, so that the clustering state $z_t^l$ will be five (L=5) sets represented by a set of cluster numbers including $z_t^1=\{1,1,1\}$, $z_t^2=\{1,1,2\}$, $z_t^3=\{1,2,1\}$, $z_t^4=\{1,2,2\}$ and $z_t^5=\{1,2,3\}$.

Assuming, for example, that a cluster center vector of data at time t is calculated as $h(z_t^l)$, in the above case of t=3, with respect to the clustering state $z_t^l$, it will be obtained by calculating a post-distribution of each cluster included in a set of each $z_t^l$ as a Gaussian distribution having a conjugate advance-distribution to take a distribution mean value of clusters including data at time t=3.

Here, $z_t^l$ and $\omega_t^l$ can be calculated by applying a particle filter method to a Dirichlet Process Mixture model, details of which are recited in, for example, Non-Patent Literature 1.

L=1 means crucial clustering and this case is also considered to be included.

Applying a constraint that one cluster includes only one data is equivalent to substantially executing no clustering, so that an applied signal will be individually handled which can be also considered to be included.

The difference calculation unit 104 calculates an expected value ΔQ (f, t) of ΔQ ($z_t^l$) shown in an Expression 8 as h( ) in the clustering unit 102 and calculates a direction of variation of the cluster center.

$$\Delta Q(z_t^l)=\frac{2(Q_t-Q_{t-1})}{|Q_t+Q_{t-1}|} \quad \text{(Expression 8)}$$

Here, the Expression 8 represents a result obtained by standardizing a cluster center vector difference $Q_t-Q_{t-1}$ including data at time t and t−1 by their mean norm $|Q_t+Q_{t-1}|/2$.

The sound source direction estimation unit 105 calculates a base vector ϕ(i) and a coefficient $a_i$ (f, t) that make I the smallest by using data of f∈F, t∈τ of ΔQ (f, t) calculated by the difference calculation unit 104 according to an Expression 9.

$$I(a,\phi)=\sum_{f\in F,t\in T}\left[\sum_m\left\{\Delta Q_m(f,t)-\sum_i a_i(f,t)\phi_m(i)\right\}^2+\xi\sum_i\ln\left(1+\left(\frac{a_i(f,t)}{r}\right)^2\right)\right] \quad \text{(Expression 9)}$$

Expression for use is not limited to the Expression 9 but is, for example, an Expression 10 as long as it is an objective function for calculating a base vector known as sparse coding. Details of sparse coding are recited in Non-Patent Literature 2.

$$I(a,\phi)=\sum_{f\in F,t\in T}\left[\sum_m\left\{\Delta Q_m(f,t)-\sum_i a_i(f,t)\phi_m(i)\right\}^2+\xi\sum_i|a_i(f,t)|\right] \quad \text{(Expression 10)}$$

Here, F represents a set of wave numbers to be taken into consideration, r represents a buffer width preceding and succeeding predetermined time t. In order to reduce instability of a sound source direction, it is possible to use a buffer width allowed to vary so as not to include a region determined as a noise interval by the voiced sound interval determination unit 106 which will be described later with t∈{t−τ1, . . . , t+τ2}.

As a sound source direction D (f, t), the sound source direction estimation unit 105 estimates a base vector which makes $a_i$ (f, t) the largest at each f, t according to an Expression 11.

$$D(f,t)=\phi_j,\ j=\underset{i}{\operatorname{argmax}}\,a_i(f,t) \quad \text{(Expression 11)}$$

ϕ and a which make I the smallest can be alternately calculated with respect to a and ϕ according to an Expression 12.

$$\phi^*=\underset{\phi}{\operatorname{argmin}}\left\{\min_a I(a,\phi)\right\} \quad \text{(Expression 12)}$$

More specifically, repeat a procedure of calculating, with ϕ fixed, a which makes I (a,ϕ) the smallest by using, for example, the conjugate gradient method and then with a fixed, calculating $\phi$ which minimizes the Expression 12 by using, for example, the steepest descent method to end when $\phi$ remains unchanged.

In sparse coding, there exists an obvious solution where a value of a coefficient a is all 0 when a norm $|\phi|$ of a base vector becomes infinitely large. In order to avoid such a case, a constraint should be imposed on $|\phi|$. Here, at the time of repetitious calculation of $\phi$ of the Expression 12, impose a constraint of the following Expression 13 to follow.

$$|\phi_i|_{new} \leftarrow |\phi_i|_{old}\left[\frac{\langle a_i^2\rangle}{\sigma_{goal}^2}\right]^a \quad \text{(Expression 13)}$$

Here, $\langle a_i^2\rangle$ is a mean value of the square of $a_i$ (f, t).

By the constraint of the Expression 13, the norm $|\phi_i|$ of the base vector is adjusted such that a root mean square of $a_i$ which is an i-th coordinate obtained when $\Delta Q$ (f, t) is expressed in a space of a base vector is on the order of designated $\sigma_{goal}^2$. As a result, when $\Delta Q$ (f, t) has a large component in a specific direction which can be plural, the norm of the base vector is calculated to have a large value and otherwise it will be calculated to have a small value.

The voiced sound index input unit 103 receives input of a voiced sound index G (f, t) indicative of a likelihood of a voiced sound interval of the multiple microphone voice signal at each time (t=1~t).

The voiced sound interval determination unit 106 calculates a sum $G_j$ (t) of voiced sound indexes G (f, t) of frequencies classified into respective sound sources $\phi$j by using the voiced sound index G (f, t) input by the voiced sound index input unit 103 and the sound source direction D (f, t) estimated by the sound source direction estimation unit 105 according to an Expression 14.

$$G_j(t) = \frac{1}{|F|}\sum_{f:\ D(f,t)=\phi} G(f,t) \quad \text{(Expression 14)}$$

Alternatively, calculate a value $G_j$ (t) which is a value obtained by weighting a certainty of a sound source direction of each sound source $\phi$j to a sum of voiced sound indexes G (f, t) of frequencies classified into respective sound sources $\phi$j according to an Expression 15.

$$G_j(t) = \frac{1}{|F|}\sum_{f:\ D(f,t)=\phi} G(f,t)\frac{|\phi_j|}{\max_i|\phi_i|} \quad \text{(Expression 15)}$$

Next, the voiced sound interval determination unit 106 compares a predetermined threshold value $\eta$ and the calculated $G_j$ (t) and when $G_j$ (t) is larger than the threshold value $\eta$, determines that the sound source direction is within a speech interval of the sound source $\phi_j$.

When $G_j$ (t) is not more than the threshold value $\eta$, determine that the sound source direction is in a noise interval.

Next, the voiced sound interval determination unit 106 outputs the determination result and the sound source direction D (f, t) as a voice interval classification result.

Effects of the First Exemplary Embodiment

Next, effects of the present exemplary embodiment will be described.

In the present exemplary embodiment, the clustering unit 102 clusters an M-dimensional space vector calculated by the vector calculation unit 101. This realizes clustering reflecting variation of a volume of sound from a sound source.

Figure 3:
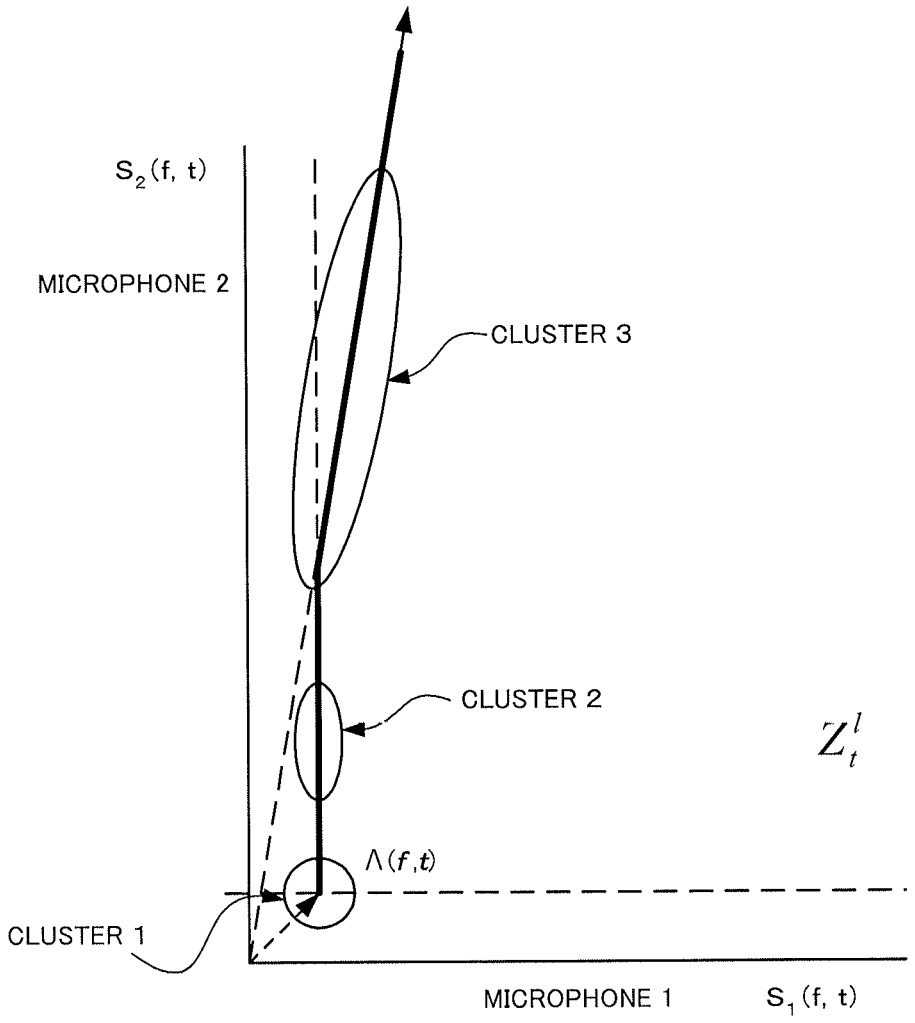
FIG. 3 is a diagram for use in explaining an effect of the present invention.

In a case of observation by two microphones as shown in FIG. 3, for example, when a speaker is making a speech near a microphone number 2, clustering executed in a certain clustering state $z_t^l$ includes a cluster 1 near a noise vector $\Lambda$ (f, t), a cluster 2 in a region where the sound volume of a microphone 1 is small and a cluster 3 in a region where the same is larger.

Here, it is not necessary to determine the number of clusters in advance because taking into consideration the clustering state $z_t^l$ having various numbers of clusters, these clustering states are stochastically handled.

When a vector S (f, t) of a power spectrum at each time is applied, the difference calculation unit 104 calculates a differential vector $\Delta Q$ (f, t) of a cluster center to which data of the time calculated by the clustering unit 102 and data of preceding time belong. Even when a volume of sound from a sound source varies, this produces an effect of allowing $\Delta Q$ (f, t) to indicate a sound source direction substantially accurately without being affected by the variation.

Figure 4:
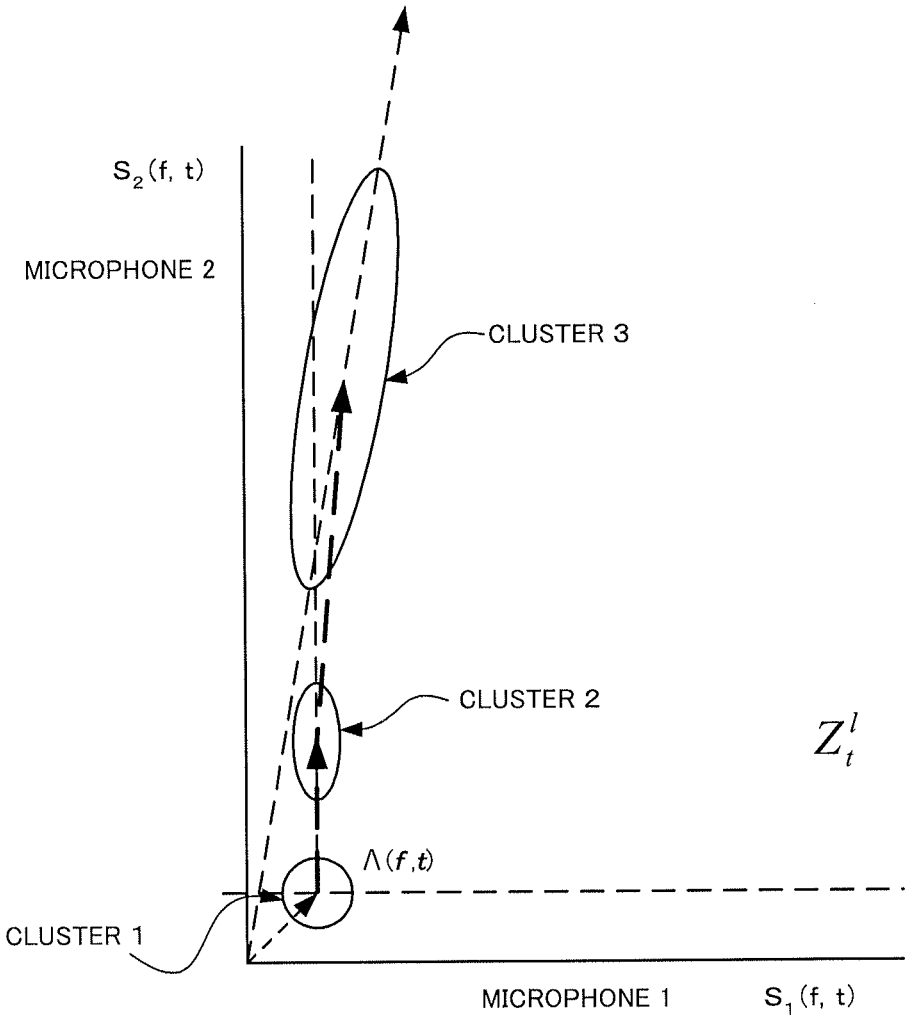
FIG. 4 is a diagram for use in explaining an effect of the present invention.
Figure 5:
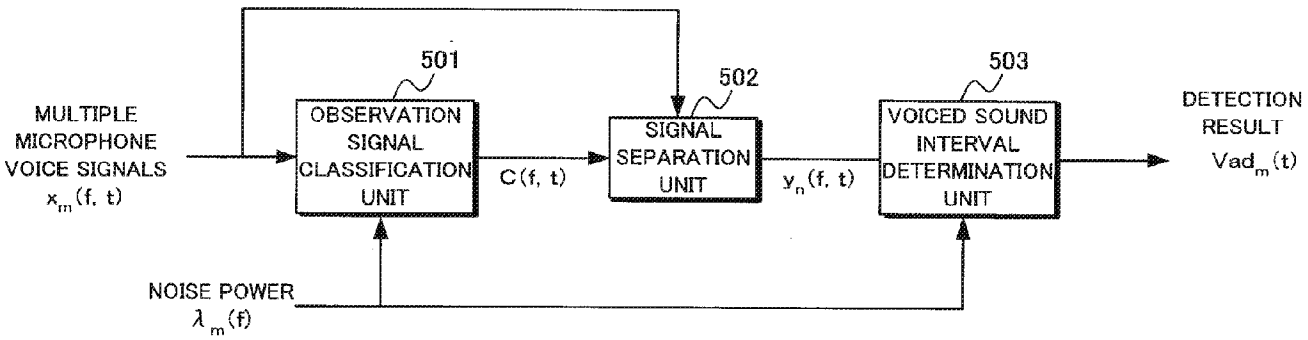
FIG. 5 is a block diagram showing a structure of a multiple microphone voice detection device according to background art.
Figure 6:
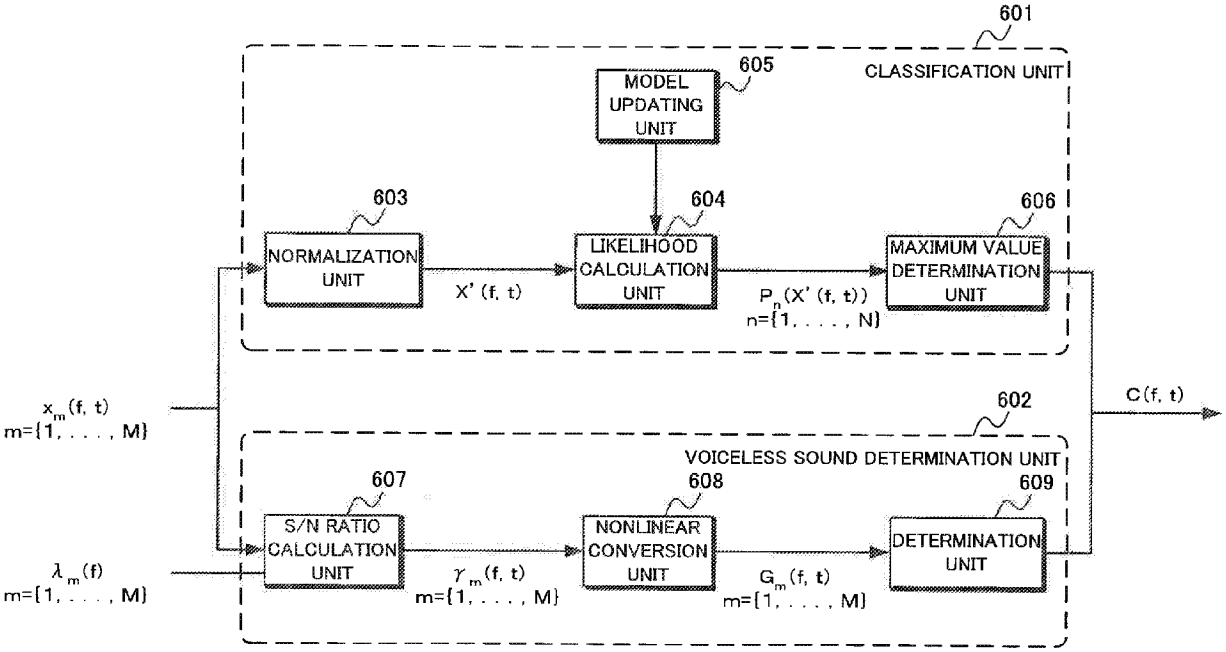
FIG. 6 is a block diagram showing a structure of a multiple microphone voice detection device according to the background art.
Figure 7:
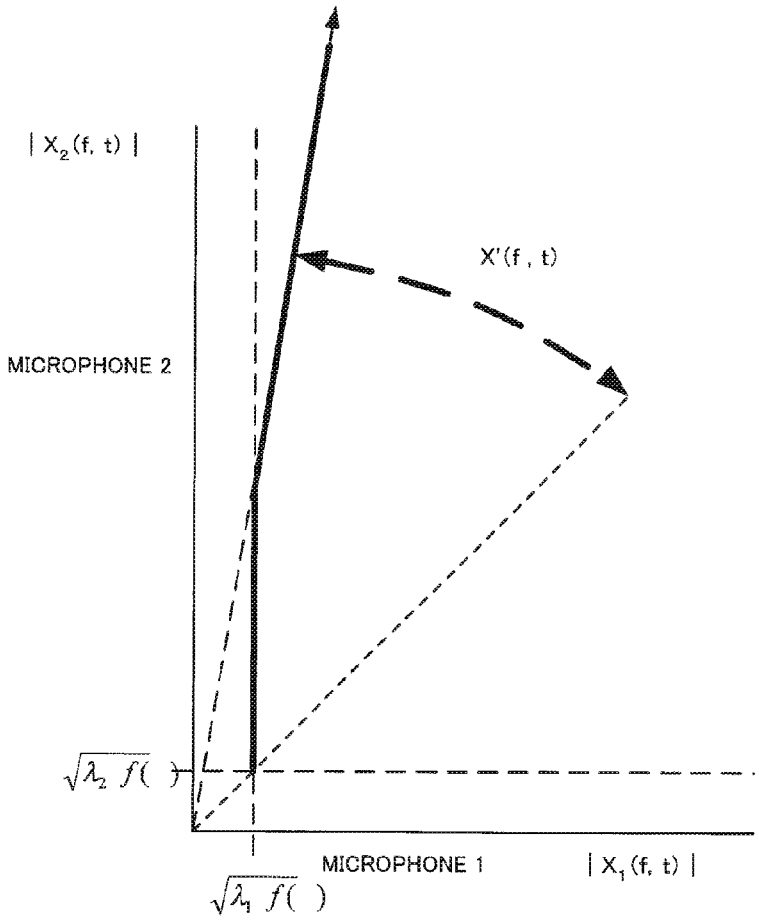
FIG. 7 is a diagram for use in explaining a problem to be solved of a multiple microphone voice detection device according to the background art.
Figure 8:
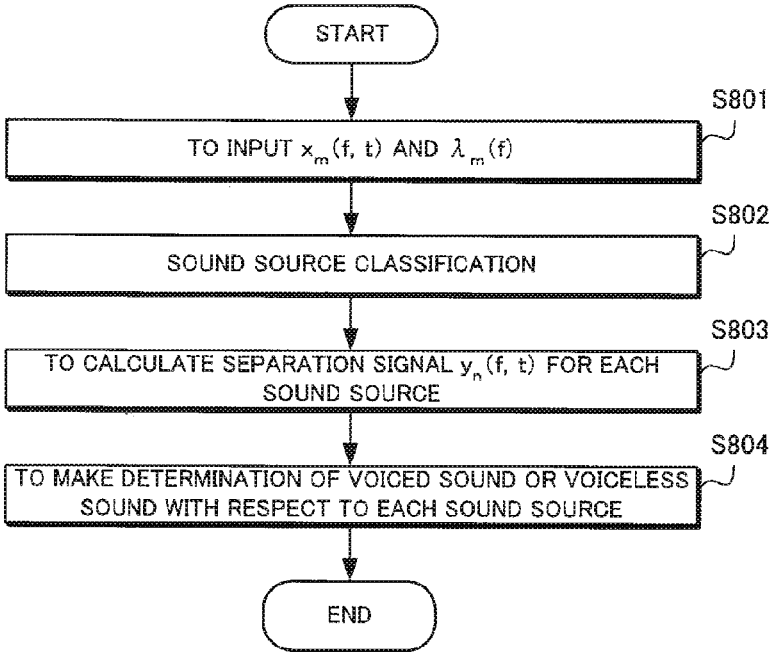
FIG. 8 is a flow chart showing operation of a multiple microphone voice detection device according to the background art.
Figure 9:
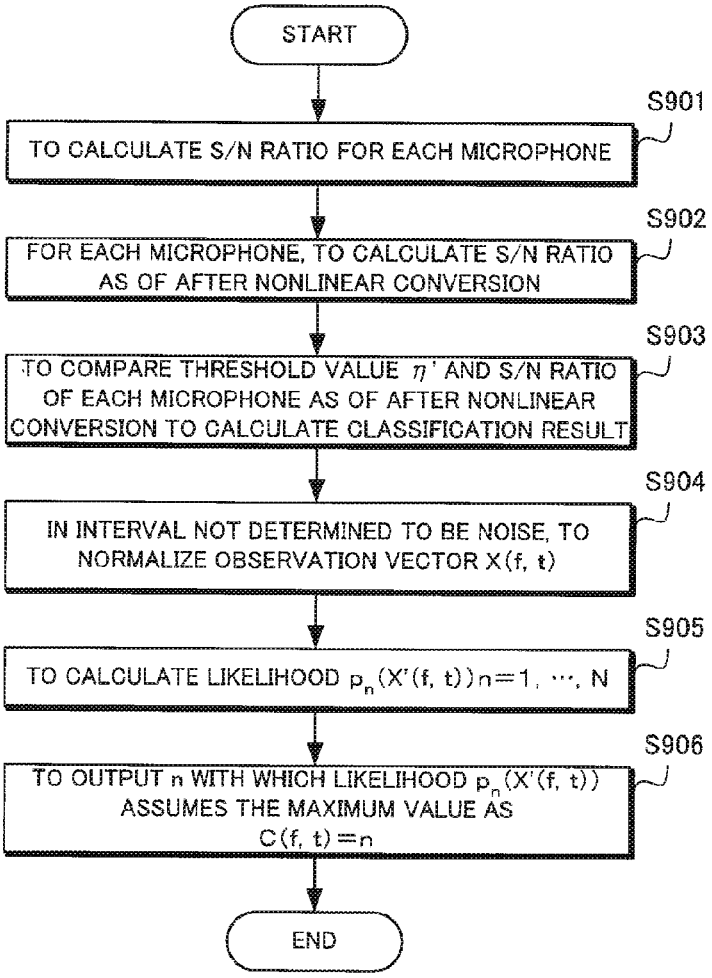
FIG. 9 is a flow chart showing operation of a multiple microphone voice detection device according to the background art.

Difference between clusters will be expressed by, for example, a vector indicated by a bold line as shown in FIG. 4, which shows that the vector indicates a sound source direction.

In addition, from the $\Delta Q$(f, t) calculated by the difference calculation unit 104, the sound source direction estimation unit 105 calculates its main components while allowing them to be non-orthogonal and exceed a space dimension. Here, it is unnecessary to know the number of sound sources in advance and neither necessary is designating an initial sound source position. Even when the number of sound sources is unknown, the effect of calculating a sound source direction can be obtained.

When a sound source direction vector is calculated by the sound source direction estimation unit 105 under the constraint of the Expression 13, it is calculated such that the norm of the base vector has a large value when $\Delta Q$ (f, t) has a large component in a specific direction which can be plural and otherwise it will be calculated to have a small value, enabling calculation of certainty of a sound source direction estimated by the norm of the sound source direction vector.

In addition, since the voiced sound interval determination unit 106 uses these more appropriate sound source directions calculated, even when a volume of sound from a sound source varies or when the number of sound sources is unknown or when different kinds of microphones are used together, voice detection for each sound source direction can be appropriately calculated to result in appropriate classification of voice intervals.

Further effect is enabling voiced sound interval determination with high precision by using an index which takes certainty of a sound source direction into consideration when the voiced sound interval determination unit 106 uses the Expression 15.

The problem of the present invention can be solved by a minimum structure including the vector calculation unit, the difference calculation unit, the sound source direction estimation unit and the voice sound interval determination unit.

Second Exemplary Embodiment

Next, a second exemplary embodiment of the present invention will be detailed with reference to the drawings. In the following drawings, no description is made as required of a structure of a part not related to a gist of the present invention and no illustration is made thereof.

Figure 2:
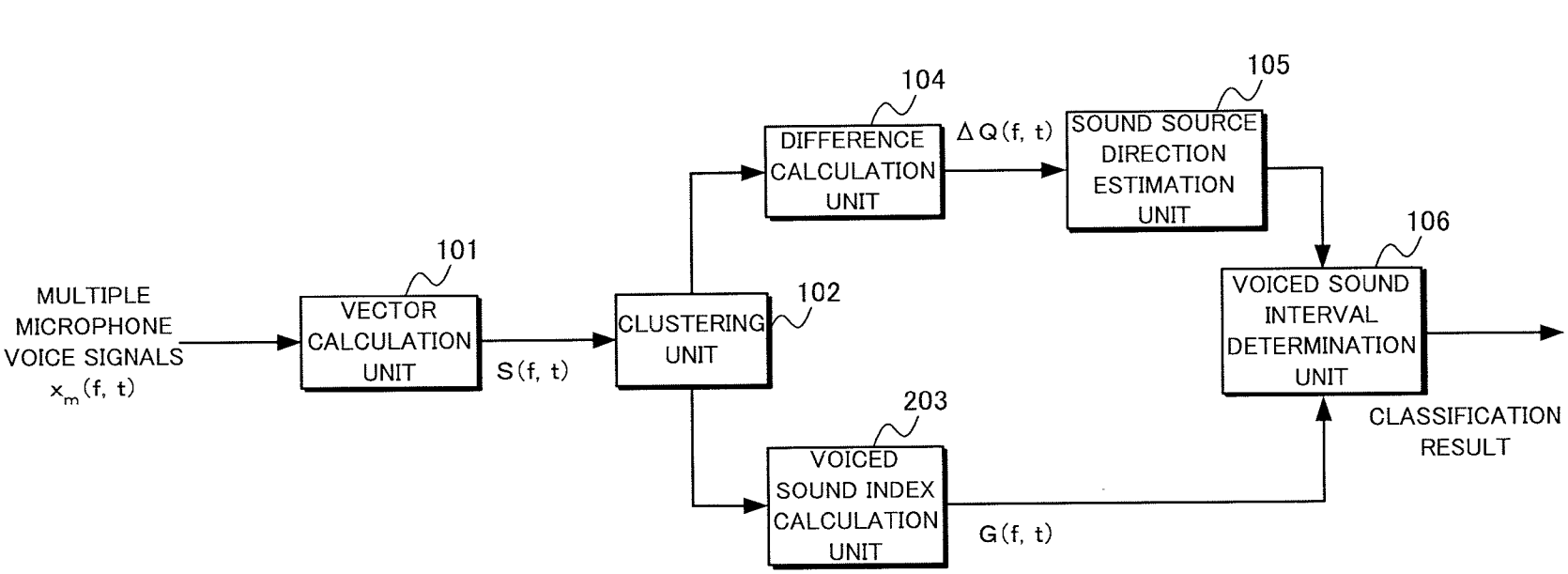
FIG. 2 is a block diagram showing a structure of a voiced sound interval classification device according to a second exemplary embodiment of the present invention.

FIG. 2 is a block diagram showing a structure of a voiced sound interval classification device 100 according to the second exemplary embodiment of the present invention.

As compared with the structure of the first exemplary embodiment shown in FIG. 1, the voiced sound interval classification device 100 according to the present exemplary embodiment includes a voiced sound index calculation unit 203 in place of the voiced sound index input unit 103.

The voiced sound index calculation unit 203 calculates an expected value G (f, t) of G ($z_t^l$) shown in the Expression 16 as the above-described h( ) at the clustering unit 102 to calculate an index of a voiced sound.

$$G(z_t^l) = \gamma(z_t^l) - \ln\gamma(z_t^l) - 1,\ \gamma(z_t^l) = \frac{Q+S}{Q+\Lambda} \qquad \text{(Expression 16)}$$

Here, Q in the Expression 16 represents a cluster center vector at time t in $z_t^l$, Λ represents a center vector having the smallest cluster center among clusters included in $z_t^l$ and S is abridged notation of S (f, t) with "•" representing an inner product.

γ in the Expression 16 corresponds to an S/N ratio calculated by projecting a noise power vector Λ and a power spectrum S each in a direction of a cluster center vector in the clustering state $z_t^l$. More specifically, G is a result obtained by expanding the following expression into M-dimensional space:

$$G_m(f,t)=\gamma_m(f,t)-\ln\gamma_m(f,t)-1.$$

The voiced sound interval determination unit 106 calculates a sum of G (f, t) of frequencies classified into respective sound sources $\phi_j$ by using G (f, t) calculated by the voiced sound index calculation unit 203 and the above-described sound source direction D (f, t) calculated by the sound source direction estimation unit 105 according to the Expression 14. Thereafter, the voiced sound interval determination unit 106 compares the calculated sum and a predetermined threshold value η and when the sum is larger, determines that the sound source direction is in the speech interval of the sound source $\phi_j$ and when it is smaller, determines that the sound source direction is in the noise interval to output the determination result and the sound source direction D (f, t) as a voiced sound interval classification result.

Effects of the Second Exemplary Embodiment

Next, effects of the present exemplary embodiment will be described.

In the present exemplary embodiment, when the power spectrum S(f, t) at each time is applied, the voiced sound index calculation unit 203 calculates a voiced sound index G (f, t) in a direction of a cluster center vector to which its data belongs.

This produces an effect of being less subject to effects caused by a difference between microphones because even when different kinds of microphones are used together, that is, even when a power spectrum value or a noise level on each microphone axis differs, clustering is executed in an M-dimensional space to calculate a cluster center vector realized taking effects of data variation into consideration and evaluate a voiced sound index in its direction.

In addition, since the voiced sound interval determination unit 106 determines a voiced sound interval by using thus calculated voiced sound index and sound source direction, appropriate classification of an observation signal sound source and appropriate detection of voice intervals are possible even when a volume of sound from a sound source varies or when the number of sound sources is unknown or when different kinds of microphones are used together.

Although a sound source in the present invention is assumed to be voice, it is not limited thereto but allows other sound source such as sound of an instrument.

Figure 10:
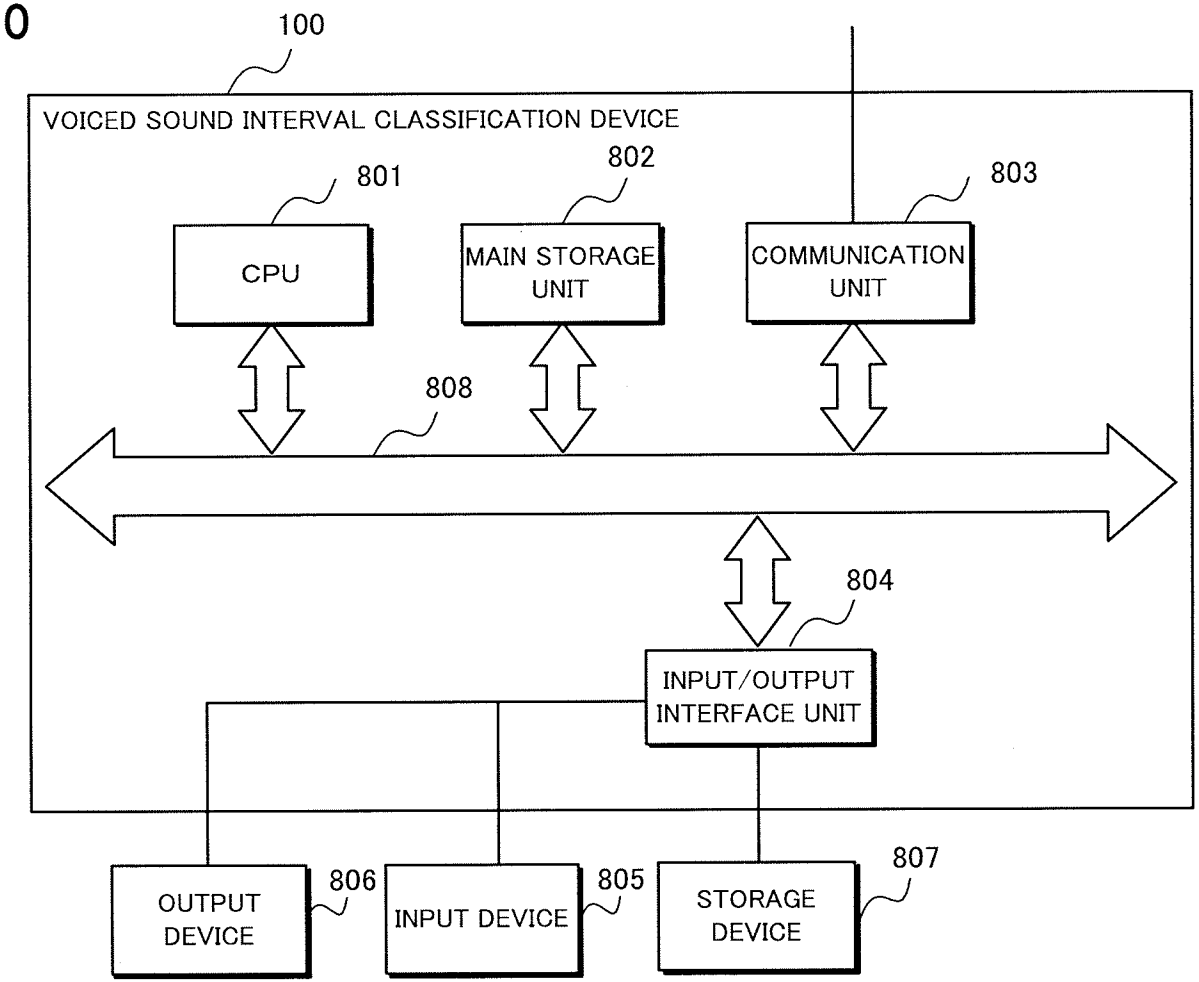
FIG. 10 is a block diagram showing an example of a hardware configuration of a voiced sound interval classification device according to the present invention.

Next, an example of a hardware configuration of the voiced sound interval classification device 100 of the present invention will be described with reference to FIG. 10. FIG. 10 is a block diagram showing an example of a hardware configuration of the voiced sound interval classification device 100.

With reference to FIG. 10, the voiced sound interval classification device 100, which has the same hardware configuration as that of a common computer device, comprises a CPU (Central Processing Unit) 801, a main storage unit 802 formed of a memory such as a RAM (Random Access Memory) for use as a data working region or a data temporary saving region, a communication unit 803 which transmits and receives data through a network, an input/output interface unit 804 connected to an input device 805, an output device 806 and a storage device 807 to transmit and receive data, and a system bus 808 which connects each of the above-described components with each other. The storage device 807 is realized by a hard disk device or the like which is formed of a non-volatile memory such as a ROM (Read Only Memory), a magnetic disk or a semiconductor memory.

The vector calculation unit 101, the clustering unit 102, the difference calculation unit 104, the sound source direction estimation unit 105, the voiced sound interval determination unit 106, the voiced sound index input unit 103 and the voiced sound index calculation unit 203 of the voiced sound interval classification device 100 according to the present invention have their operation realized not only in hardware by mounting a circuit part which is a hardware part such as an LSI (Large Scale Integration) with a program incorporated but also in software by storing a program which provides the function in the storage device 807, loading the program into the main storage unit 802 and executing the same by the CPU 801.

Hardware configuration is not limited to those described above.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

An arbitrary combination of the foregoing components and conversion of the expressions of the present invention to/from a method, a device, a system, a recording medium, a computer program and the like are also available as a mode of the present invention.

In addition, the various components of the present invention need not always be independent from each other, and a plurality of components may be formed as one member, or one component may be formed by a plurality of members, or a certain component may be a part of other component, or a part of a certain component and a part of other component may overlap with each other, or the like.

While the method and the computer program of the present invention have a plurality of procedures recited in order, the order of recitation is not a limitation to the order of execution of the plurality of procedures. When executing the method and the computer program of the present invention, therefore, the order of execution of the plurality of procedures can be changed without hindering the contents.

Moreover, execution of the plurality of procedures of the method and the computer program of the present invention are not limitedly executed at timing different from each other. Therefore, during the execution of a certain procedure, other procedure may occur, or a part or all of execution timing of a certain procedure and execution timing of other procedure may overlap with each other, or the like.

Furthermore, a part or all of the above-described exemplary embodiments can be recited as the following claims but are not to be construed limitative.

The whole or part of the exemplary embodiments disclosed above can be described as, but not limited to, the following supplementary notes.

(Supplementary note 1.) A voiced sound interval classification device comprising:

a vector calculation unit which calculates, from a power spectrum time series of voice signals collected by a plurality of microphones, a multidimensional vector series as a vector series of a power spectrum having as many dimensions as the number of said microphones, a difference calculation unit which calculates, with respect to each time of said multidimensional vector series sectioned by an arbitrary time length, a vector of a difference between the time in question and the preceding time, a sound source direction estimation unit which estimates, as a sound source direction, a main component of said differential vector obtained while allowing the vector to be non-orthogonal and exceed a space dimension, and a voiced sound interval determination unit which determines whether each sound source direction obtained by said sound source direction estimation unit is in a voiced sound interval or a voiceless sound interval by using a predetermined voiced sound index indicative of a likelihood of a voiced sound interval of said voice signal applied at each time.

(Supplementary note 2.) The voiced sound interval classification device according to supplementary note 1, wherein said voiced sound interval determination unit calculates a sum of said voiced sound indexes of the respective times with respect to said sound source direction and compares the sum with a predetermined threshold value to determine whether said sound source direction is in a voiced sound interval or a voiceless sound interval.

(Supplementary note 3.) The voiced sound interval classification device according to supplementary note 1 or supplementary note 2, further comprising:

a clustering unit which clusters said multidimensional vector series, wherein said difference calculation unit calculates said differential vector based on a clustering result of said clustering unit.

(Supplementary note 4.) The voiced sound interval classification device according to supplementary note 3, wherein said clustering unit executes stochastic clustering, and said difference calculation unit calculates an expected value of a differential vector from said clustering result.

(Supplementary note 5.) The voiced sound interval classification device according to any one of supplementary note 1 through supplementary note 4, wherein said multidimensional vector series is a vector series of a logarithm power spectrum.

(Supplementary note 6.) The voiced sound interval classification device according to any one of supplementary note 1 through supplementary note 5, further comprising:

a voiced sound index calculation unit which calculates said voiced sound index, wherein at each time of said multidimensional vector series sectioned by an arbitrary time length, said voiced sound index calculation unit calculates a center vector of a noise cluster and a center vector of a cluster to which a vector of said voice signal at the time in question belongs and after projecting the center vector of said noise cluster and the vector of the time in question toward a direction of the center vector of the cluster to which the vector of said voice signal at the time in question belongs, calculates a signal noise ratio as a voiced sound index.

(Supplementary note 7.) A voiced sound interval classification method of a voiced sound interval classification device which classifies a voiced sound interval from voice signals collected by a plurality of microphones on a sound source basis, comprising:

the vector calculation step of calculating, from a power spectrum time series of said voice signals collected by a plurality of microphones, a multidimensional vector series as a vector series of a power spectrum having as many dimensions as the number of said microphones, the difference calculation step of calculating, with respect to each time of said multidimensional vector series sectioned by an arbitrary time length, a vector of a difference between the time in question and the preceding time, the sound source direction estimation step of estimating, as a sound source direction, a main component of said differential vector obtained while allowing the vector to be non-orthogonal and exceed a space dimension, and the voiced sound interval determination step of determining whether each sound source direction obtained by said sound source direction estimation step is in a voiced sound interval or a voiceless sound interval by using a predetermined voiced sound index indicative of a likelihood of a voiced sound interval of said voice signal applied at each time.

(Supplementary note 8.) The voiced sound interval classification method according to supplementary note 7, wherein said voiced sound interval determination step includes calculating a sum of said voiced sound indexes of the respective times with respect to said sound source direction and comparing the sum with a predetermined threshold value to determine whether said sound source direction is in a voiced sound interval or a voiceless sound interval.

(Supplementary note 9.) The voiced sound interval classification method according to supplementary note 7 or supplementary note 8, further comprising:

the clustering step of clustering said multidimensional vector series, wherein said difference calculation step includes calculating said differential vector based on a clustering result of said clustering step.

(Supplementary note 10.) The voiced sound interval classification method according to supplementary note 9, wherein said clustering step includes executing stochastic clustering, and said difference calculation step includes calculating an expected value of a differential vector from said clustering result.

(Supplementary note 11.) The voiced sound interval classification method according to any one of supplementary note 7 through supplementary note 10, wherein said multidimensional vector series is a vector series of a logarithm power spectrum.

(Supplementary note 12.) The voiced sound interval classification method according to any one of supplementary note 7 through supplementary note 11, further comprising:

the voiced sound index calculation step of calculating said voiced sound index, wherein at each time of said multidimensional vector series sectioned by an arbitrary time length, said voiced sound index calculation step includes calculating a center vector of a noise cluster and a center vector of a cluster to which a vector of said voice signal at the time in question belongs and after projecting the center vector of said noise cluster and the vector of the time in question toward a direction of the center vector of the cluster to which the vector of said voice signal at the time in question belongs, calculating a signal noise ratio as a voiced sound index.

(Supplementary note 13.) A voiced sound interval classification program operable on a computer which functions as a voiced sound interval classification device which classifies a voiced sound interval from voice signals collected by a plurality of microphones on a sound source basis, which program causes said computer to execute:

the vector calculation processing of calculating, from a power spectrum time series of said voice signals collected by a plurality of microphones, a multidimensional vector series as a vector series of a power spectrum having as many dimensions as the number of said microphones, the difference calculation processing of calculating, with respect to each time of said multidimensional vector series sectioned by an arbitrary time length, a vector of a difference between the time in question and the preceding time, the sound source direction estimation processing of estimating, as a sound source direction, a main component of said differential vector obtained while allowing the vector to be non-orthogonal and exceed a space dimension, and the voiced sound interval determination processing of determining whether each sound source direction obtained by said sound source direction estimation processing is in a voiced sound interval or a voiceless sound interval by using a predetermined voiced sound index indicative of a likelihood of a voiced sound interval of said voice signal applied at each time.

(Supplementary note 14.) The voiced sound interval classification program according to supplementary note 13, wherein said voiced sound interval determination processing includes calculating a sum of said voiced sound indexes of the respective times with respect to said sound source direction and comparing the sum with a predetermined threshold value to determine whether said sound source direction is in a voiced sound interval or a voiceless sound interval.

(Supplementary note 15.) The voiced sound interval classification program according to supplementary note 13 or supplementary note 14, which causes said computer to execute the clustering processing of clustering said multidimensional vector series, wherein said difference calculation processing includes calculating said differential vector based on a clustering result of said clustering processing.

(Supplementary note 16.) The voiced sound interval classification program according to supplementary note 15, wherein said clustering processing includes executing stochastic clustering, and said difference calculation processing includes calculating an expected value of a differential vector from said clustering result.

(Supplementary note 17.) The voiced sound interval classification program according to any one of supplementary note 13 through supplementary note 16, wherein said multidimensional vector series is a vector series of a logarithm power spectrum.

(Supplementary note 18.) The voiced sound interval classification program according to any one of supplementary note 13 through supplementary note 17, which causes said computer to execute the voiced sound index calculation processing of calculating said voiced sound index, wherein at each time of said multidimensional vector series sectioned by an arbitrary time length, said voiced sound index calculation processing includes calculating a center vector of a noise cluster and a center vector of a cluster to which a vector of said voice signal at the time in question belongs and after projecting the center vector of said noise cluster and the vector of the time in question toward a direction of the center vector of the cluster to which the vector of said voice signal at the time in question belongs, calculating a signal noise ratio as a voiced sound index.

INDUSTRIAL APPLICABILITY

The present invention is applicable to such use as speech interval classification for executing recognition of voice collected by using multiple microphones.

What is claimed is:

1. A voiced sound interval classification device for determining whether voice signals collected by a plurality of microphones are in a voice sound interval or a voiceless sound interval, comprising:

at least one memory operable to store program instructions;

at least one processor operable to read the stored program instructions; and according to the stored program instructions, the at least one processor is configured to be operated as:

a vector calculation unit which calculates, from a power spectrum time series of said voice signals collected by said plurality of microphones, a multidimensional vector series as a vector series of a power spectrum having as many dimensions as the number of said plurality of microphones;

a difference calculation unit which calculates, with respect to each time of said multidimensional vector series sectioned by an arbitrary time length, a vector of a difference between the time in question and the preceding time;

a sound source direction estimation unit which estimates, as a sound source direction, a main component of a plurality of main components of said differential vector obtained while allowing the plurality of main components of said differential vector to be non-orthogonal and exceed a space dimension; and a voiced sound interval determination unit which determines whether each sound source direction obtained by said sound source direction estimation unit is in a voiced sound interval or a voiceless sound interval by using a predetermined voiced sound index indicative of a likelihood of a voiced sound interval of said voice signal applied at each time;

wherein said sound source direction estimation unit further calculates said sound source direction as a vector, and calculates certainty of said sound source direction estimated by the norm of the sound source direction vector, and said voiced sound interval determination unit further calculates a sum of said voiced sound indexes of the respective times with respect to said sound source direction, and calculates a multiplication value of the sum of said voiced sound indexes of the respective times with respect to said sound source direction and the norm of the sound source direction vector estimated in the voiced sound index, and compares the multiplication value with a predetermined threshold value to determine whether said sound source direction is in a voiced sound interval or a voiceless sound interval.

2. The voiced sound interval determination unit according to claim 1, further compares the sum of said voiced sound indexes of the respective times with respect to said sound source direction with a predetermined threshold value to determine whether said sound source direction is in a voiced sound interval or a voiceless sound interval.

3. The voiced sound interval classification device according to claim 1, wherein the at least one processor is further configured to be operated as a clustering unit which clusters said multidimensional vector series, wherein said difference calculation unit calculates said differential vector based on a clustering result of said clustering unit.

4. The voiced sound interval classification device according to claim 3, wherein said clustering unit executes stochastic clustering, and said difference calculation unit calculates an expected value of a differential vector from said clustering result.

5. The voiced sound interval classification device according to claim 1, wherein said multidimensional vector series is a vector series of a logarithm power spectrum.

6. The voiced sound interval classification device according to claim 1, wherein the at least one processor is further configured to be operated as:

a voiced sound index calculation unit which calculates said voiced sound index, wherein at each time of said multidimensional vector series sectioned by an arbitrary time length, said voiced sound index calculation unit calculates a center vector of a noise cluster and a center vector of a cluster to which a vector of said voice signal at the time in question belongs and after projecting the center vector of said noise cluster and the vector of said voice signal at the time in question toward a direction of the center vector of the cluster to which the vector of said voice signal at the time in question belongs, calculates a signal noise ratio as a voiced sound index.

7. A voiced sound interval classification method, for determining whether voice signals collected by a plurality of microphones are in a voice sound interval or a voiceless sound interval, of a voiced sound interval classification device, comprising at least one memory operable to store program instructions and at least one processor operable to read the stored program instructions, which classifies a voiced sound interval from said voice signals collected by said plurality of microphones on a sound source basis, comprising:

a vector calculation step of calculating, by said at least one processor according to said stored program instructions, from a power spectrum time series of said voice signals collected by said plurality of microphones, a multidimensional vector series as a vector series of a power spectrum having as many dimensions as the number of said plurality of microphones;

a difference calculation step of calculating, by said at least one processor according to said stored program instructions, with respect to each time of said multidimensional vector series sectioned by an arbitrary time length, a vector of a difference between the time in question and the preceding time;

a sound source direction estimation step of estimating, by said at least one processor according to said stored program instructions, as a sound source direction, a main component of a plurality of main components of said differential vector obtained while allowing the plurality of main components of the differential vector to be non-orthogonal and exceed a space dimension;

a voiced sound interval determination step of determining by said at least one processor according to said stored program instructions, whether each sound source direction obtained by said sound source direction estimation step is in a voiced sound interval or a voiceless sound interval by using a predetermined voiced sound index indicative of a likelihood of a voiced sound interval of said voice signal applied at each time;

wherein said sound source direction estimation step further comprises calculating said sound source direction as a vector, and calculating certainty of said sound source direction estimated by the norm of the sound source direction vector, and said voiced sound interval determination step further comprises calculating a sum of said voiced sound indexes of the respective times with respect to said sound source direction, and calculating a multiplication value of the sum of said voiced sound indexes of the respective times with respect to said sound source direction and the norm of the sound source direction vector estimated in the voiced sound index, and comparing the multiplication value with a predetermined threshold value to determine whether said sound source direction is in a voiced sound interval or a voiceless sound interval.

8. The voiced sound interval classification method according to claim 7, further comprising a clustering step of clustering said multidimensional vector series, wherein said difference calculation step includes calculating said differential vector based on a clustering result of said clustering step.

9. A non-transitory computer-readable medium storing a voiced sound interval classification program for determining whether voice signals collected by a plurality of microphones are in a voice sound interval or a voiceless sound interval, operable on a computer which functions as a voiced sound interval classification device which classifies a voiced sound interval from said voice signals collected by said plurality of microphones on a sound source basis, wherein said voiced sound interval classification program causes said computer to execute:

a vector calculation processing of calculating, from a power spectrum time series of said voice signals collected by said plurality of microphones, a multidimensional vector series as a vector series of a power spectrum having as many dimensions as the number of said plurality of microphones;

a difference calculation processing of calculating, with respect to each time of said multidimensional vector series sectioned by an arbitrary time length, a vector of a difference between the time in question and the preceding time;

a sound source direction estimation processing of estimating, as a sound source direction, a main component of a plurality of main components of said differential vector obtained while allowing the plurality of main components of the differential vector to be non-orthogonal and exceed a space dimension;

a voiced sound interval determination processing of determining whether each sound source direction obtained by said sound source direction estimation processing is in a voiced sound interval or a voiceless sound interval by using a predetermined voiced sound index indicative of a likelihood of a voiced sound interval of said voice signal applied at each time;

wherein said sound source direction estimation processing of estimating further comprises calculating said sound source direction as a vector, and calculating certainty of said sound source direction estimated by the norm of the sound source direction vector, and said voiced sound interval determination processing of determining further comprises calculating a sum of said voiced sound indexes of the respective times with respect to said sound source direction, and calculating a multiplication value of the sum of said voiced sound indexes of the respective times with respect to said sound source direction and the norm of the sound source direction vector estimated in the voiced sound index, and comparing the multiplication value with a predetermined threshold value to determine whether said sound source direction is in a voiced sound interval or a voiceless sound interval.

* * * * *